United States Patent [19]

Kasai

[11] 4,306,347

[45] Dec. 22, 1981

[54] METHOD FOR MANUFACTURING SLIDE FASTENER ELEMENTS

[75] Inventor: Kazumi Kasai, Namerikawa, Japan

[73] Assignee: Yoshida Kogyo K.K., Tokyo, Japan

[21] Appl. No.: 98,532

[22] Filed: Nov. 29, 1979

[30] Foreign Application Priority Data

Dec. 5, 1978 [JP] Japan ..... 53-150701

[51] Int. Cl.[3] ..... B21D 53/52

[52] U.S. Cl. ..... 29/410

[58] Field of Search ..... 29/408, 410, 417, 766

[56] References Cited

U.S. PATENT DOCUMENTS

| | | | |
|---|---|---|---|
| 2,622,295 | 12/1952 | Mikulas | 29/410 X |
| 2,685,127 | 8/1954 | Kaufmann | 29/410 |
| 3,091,024 | 5/1963 | Poux | 29/410 |
| 3,136,046 | 6/1964 | Chery | 29/410 |
| 3,548,483 | 12/1970 | Graf et al. | 29/410 |

FOREIGN PATENT DOCUMENTS

| | | | |
|---|---|---|---|
| 206416 | 11/1939 | Switzerland | 29/410 |

*Primary Examiner*—James G. Smith

*Attorney, Agent, or Firm*—Hill, Van Santen, Steadman, Chiara & Simpson

[57] ABSTRACT

A method for manufacturing slide fastener elements from a metal strip by press working, each element comprising a head portion and a pair of spaced leg portions extending rearwardly from the head portion is disclosed. The head portion includes on each side of the top and bottom surfaces thereof a first projection extending substantially perpendicular to the longitudinal direction of the leg portions and a pair of second projections each extending from near one end of the first projection to rearward. The method comprises the steps of preparing a metal strip having two parallel ridges provided on each side of the top and bottom surfaces thereof and extending the length of the strip, deforming the ridges on each side of the strip at predetermined spaces so as to intimately contact two ridges to each other at predetermined spaces to thereby form a series of first semi-worked projections and leaving a series of second remained projections between the first semi-worked projections, deforming the first semi-worked projections and second remained projections to make the first projections and second projections respectively and simultaneously reducing the thickness of the inside and outside portions defined by the first semiworked projections and the second remained projections to less than that of the leg portions so that the excess material of the reduced portions flow to contribute to the formation of the first and second projections, forming the external shape of the leg portions by punching the strip, and separating the strip into individual fastener elements by punching the same.

3 Claims, 7 Drawing Figures

METHOD FOR MANUFACTURING SLIDE FASTENER ELEMENTS

BACKGROUND OF THE INVENTION

This invention relates to an improved method for manufacturing individual slide fastener elements from a metal strip by press working.

Heretofore, various methods for manufacturing individual slide fastener elements by press working have been suggested, the slide fastener elements made by each of these methods include interlocking projections and a pocket on each side of the top and bottom surfaces of a head portion thereof and a pair of spaced leg portions adapted to be clamped on the beaded edge of the fastener tape. In a typical method of such methods, the interlocking projections are directly formed by embossing portions of the flat top and bottom surfaces of a metal strip. By this embossing method, however, it is impossible to provide projections of sufficient height even though the thickness of the metal strip is increased and the fastener chain thus obtained does not have sufficient interlocking force. Also, in this method, if the thickness of the strip is increased, the pitch for attaching the fastener elements on the fastener tape is correspondingly increased, because the thickness of the leg portions of the fastener element corresponds to the increase of the strip and this increases the resistance to the sliding movement of the slider over the fastener chain, the flexibility of the fastener chain is greatly diminished and further more material is required for producing the fastener elements. On the other hand, if the thickness of the strip is decreased, the height of the embossed projections is correspondingly decreased, and thus, the interlocking force of the fastener chain is decreased. In another method, the metal strip from which the fastener elements are formed includes a medial ridge on each side of the top and bottom surfaces thereof and the interlocking projections and pockets are formed by deforming such ridges. One example of such method is disclosed in U.S. Pat. No. 3,136,046. In this method, however, as the interlocking projections are regularly spaced on the strip, the portions of the ridges which do not contribute to the formation of the projections must be depressed to the level of the strip. When the portions of the ridges are depressed, the web portion of the strip is concurrently pressed and the width of the strip is correspondingly increased. To prevent this, the ridges must be limited to a relatively low height, and, therefore, the projections are limited to a relatively low height. In another method, the fastener elements are formed step-by-step by press working from a round metal wire. One example of such method is disclosed in U.S. Pat. No. 2,622,295. However, this method includes many working steps and is very disadvantageous from a manufacturing cost standpoint. Also, in this method, the metal strip in which a series of the fastener elements are formed must be separated into the individual fastener elements by once removing the strip from the press machine and then advancing it in reverse direction in the separating machine. Thus the operation is very inefficient.

SUMMARY OF THE INVENTION

Therefore, one object of this invention is to provide improved method for manufacturing a slide fastener element from a metal strip by press working whereby the embossed interlocking projections of the elements can be made sufficiently high but the thickness of the leg portions of the fastener elements can be kept to the minimum.

Another object of this invention is to provide an improved method whereby the interlocking projections of the fastener elements can be formed with relatively low pressure with little flow of the material.

Still another object of this invention is to provide an improved method whereby the interlocking projections of the fastener elements can be formed economically through relatively simple working steps.

The present invention may be summarized as a method for manufacturing slide fastener elements from a metal strip by press working, each element comprising a head portion and a pair of spaced leg portions extending rearwardly from the head portion, the head portion including on each side of the top and bottom surfaces thereof a first projection extending substantially perpendicular to the longitudinal direction of the leg portions and a pair of second projections each extending from near one end of the first projection to rearward, the method comprises steps of preparing a metal strip having two parallel ridges on each side of the top and bottom surfaces thereof and extending the length of the strip, deforming the ridges on each side of the strip at predetermined spaces so as to intimately contact two ridges to each other at predetermined spaces to thereby form a series of first semi-worked projections and leaving a series of second remained projections between the first semi-worked projections, deforming the first semi-worked projections and second remained projections to make the first and second projections respectively and simultaneously reducing the thickness of the inside and outside portions defined by the first semi-worked projections and the second remained projections to less than that of the leg portions so that the excess material of the reduced portions flows to contribute to the formation of the first and second projections, forming the external shape of the leg portions by punching the strip, and separating the strip into individual fastener elements by punching the same.

BRIEF DESCRIPTION OF THE DRAWINGS

FIG. 5 is an enlarged cross-sectional view of a portion of the strip and dies showing the first working step of the invention, wherein FIG. 5(A) shows the pre-work state and FIG. 5(B) shows the post-work state;

FIG. 6 is an enlarged cross-sectional view of a portion of the strip and dies showing the pre-work state of the strip and dies in the second working step of the invention, wherein FIG. 6(A) shows positional relationship between the dies and the first semi-worked projections of the strip and FIG. 6(B) shows positional relationship between the dies and the second remained projections of the strip.

DESCRIPTION OF THE PREFERRED EMBODIMENTS

Hereinafter, one preferred embodiment of this invention will be explained with reference to the accompanying drawings.

Figure 1:
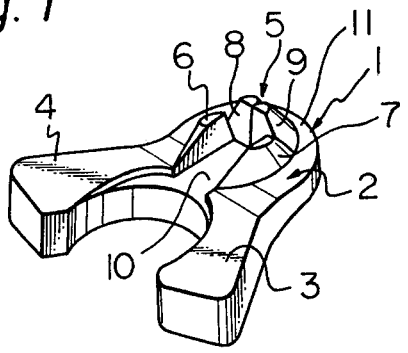
FIG. 1 is an enlarged perspective view of one example of a fastener element formed by the method of this invention.
Figure 2:
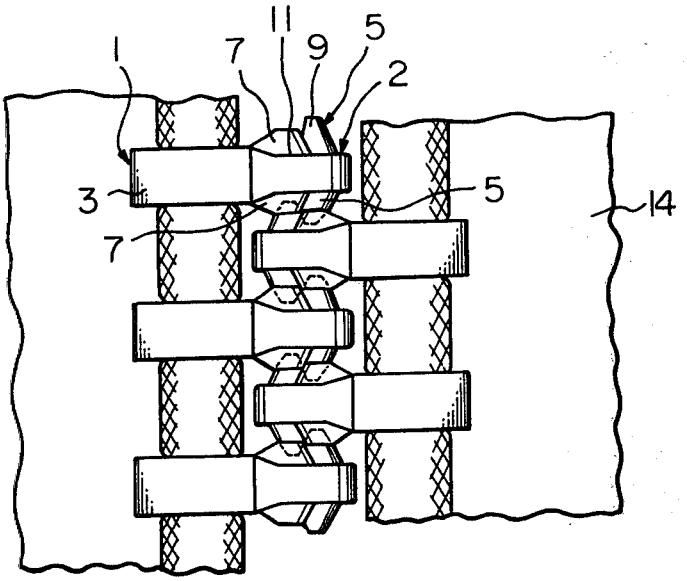
FIG. 2 is an enlarged plan view of a fragment of a fastener chain with the fastener elements of FIG. 1 attached thereon.

FIG. 1 shows a fastener element 1 formed by the method of this invention. The fastener element 1 includes a head portion 2 and a pair of spaced leg portions 3, 4 which extend rearwardly from the head portion 2. On each side of the top and bottom surfaces of the head portion 2, there are provided a first projection 5 and a pair of second projections 6, 7. The first projection 5 extends substantially perpendicular to the longitudinal direction of the leg portions 3, 4. The second projections 6, 7 extend substantially in parallel to the longitudinal direction of the leg portions 3, 4 and each one extends rearwardly from near one end of the first projection 5. As shown in FIG. 1, the first projection 5 is formed by two deformed projections 8, 9 which are intimately contacted along the center line of the head portion 2. On each side of the top and bottom surfaces of the head portion 2, these first and second projections 5, 6, 7 define a pocket portion 10 at the inside thereof and peripheral portions 11 at outside thereof. The thickness of the pocket portion 10 and the peripheral portion 11 is less than that of the leg portions 3, 4. As shown in FIG. 2, the fastener elements 1 of FIG. 1 are clamped on the beaded edge of a fastener tape 14 in the usual manner and to form a fastener chain.

Figure 3:
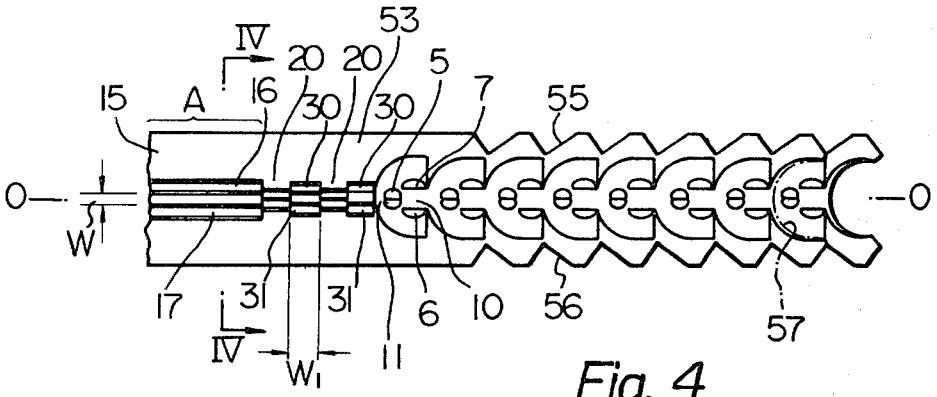
FIG. 3 is an enlarged paln view of a metal strip being formed into the fastener elements.
Figure 4:
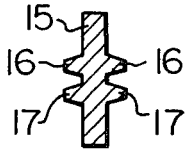
FIG. 4 is a cross-sectional view taken along line IV—IV of FIG. 3.

The fastener element 1 of FIG. 1 is formed from a metal strip 15 the paln view of which is shown in region A in FIG. 3 and the sectional view of which is shown in FIG. 4. As shown in FIGS. 3 and 4, the metal strip 15 has on each side of the top and bottom surfaces thereof a pair of ridges 16, 17 which are spaced from each other by the distance W and extend in parallel in the longitudinal direction of the strip 15.

Figure 5:
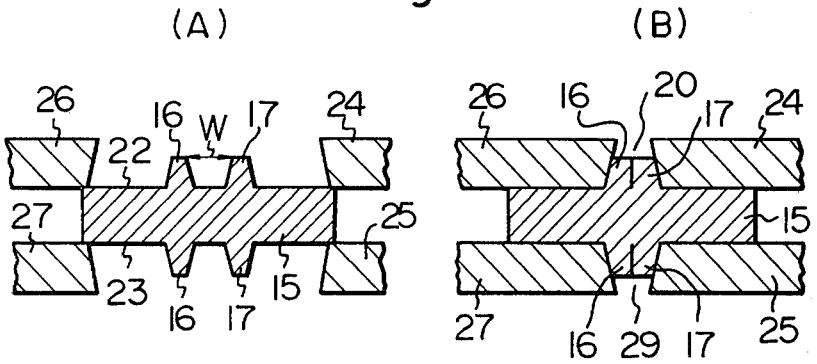

The fastener element 1 is formed from the strip 15 as follows. In the first working step, the strip 15 is deformed by press working so that the ridges 16, 17 on each side of the strip 15 are brought together on the center line 0-0 of the strip at predetermined spaces and a series of first semi-worked projections 20, 29 (FIGS. 3, 5 and 6) which form embryo projections of the first projections 5, 5 are formed on the strip 15. More specifically, referring to FIGS. 5A and 5B, dies 24, 25, 26, 27 are disposed so that they can reciprocate perpendicularly to the longitudinal direction of the ridges 16, 17 along both top and bottom surfaces 22, 23 of the strip between open and closed positions. And when these dies 24, 25, 26, 27 are advanced to the closed position as shown in FIG. 5(B), the material of a pair of ridges 16, 17 on each side of the strip is moved by the dies until ridges 16, 17 are intimately contacted. By this, the first semi-worked projections 20, 29 are formed on each side of the strip. As shown in FIG. 3, the first semi-worked projections 20, 29 are formed at predetermined points each being spaced by the distance $W_1$ from the following one. This distance $W_1$ corresponds to the pitch of the fastener elements to be formed in the strip 15. The portions 30, 31 of the ridges 16, 17 which are not deformed by the dies 24, 25, 26, 27 are left as second remained projections between the first semi-worked projections. These remained projections 30, 31 are the embryo projections of the second projections 6, 7 of the fastener element.

Figure 6:
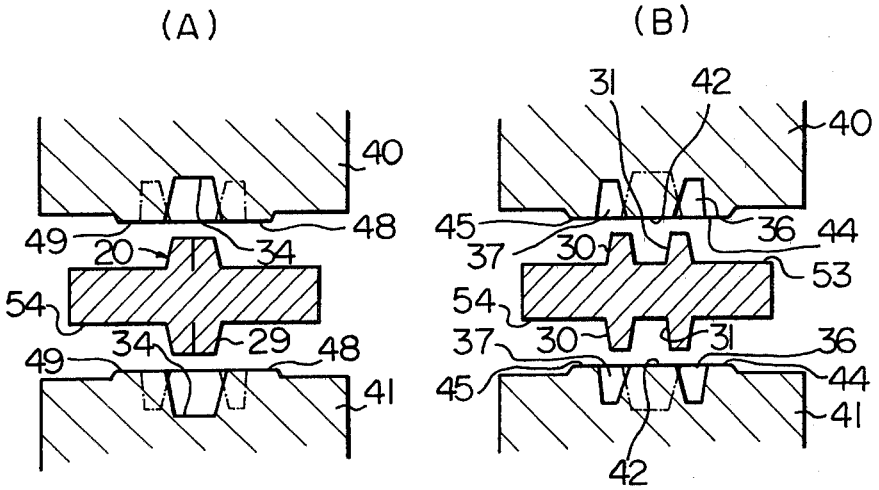
Figure 7:
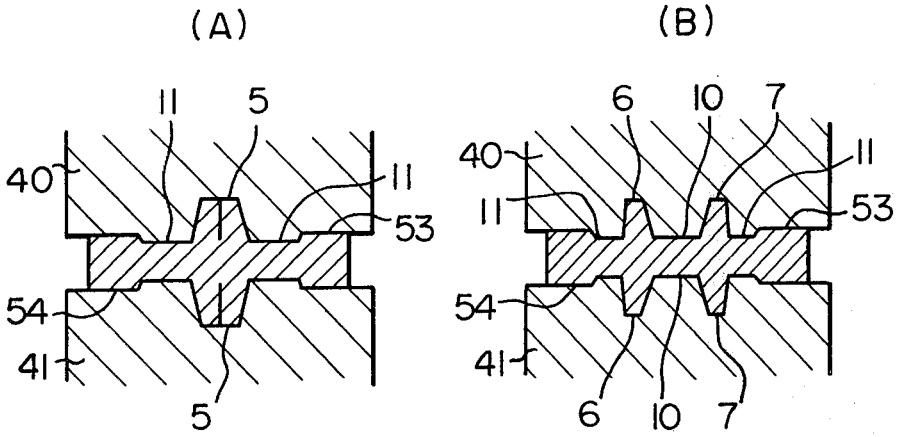
FIG. 7 is a view similar to FIG. 6 but showing the postwork state of the strip and the dies in the step of FIG. 6, wherein FIG. 7(A) corresponds to FIG. 6(A) and FIG. 7(B) corresponds to FIG. 6(B).

In the next working step of the invention, the first semi-worked projections 20, 29 and the second remained projections 30, 31 are deformed by press working to the first projections 5 and the second projections 6, 7 respectively. For this purpose, a pair of upper and lower dies 40, 41 are disposed so that they can reciprocate toward and away from the strip 15 between the closed and open positions. As shown in FIGS. 6 and 7, these dies 40 and 41 have same configuration, and include cavity 34 for forming the first projection 5 and cavities 36, 37 for forming the second projections 6, 7 respectively. The dies 40, 41 also include a bulge portion 42 between the cavities 36 and 37 for forming the pocket portion 10 and bulge portions 44, 45 outside of the cavities 36, 37 for forming the peripheral portion 11 respectively.

The cavities 34 and 36, 37 are positioned in the dies 40, 41 so that at least a portion of the entrance thereof facing the corresponding first semi-worked projections 20, 29 and the second remained projections 30, 31 respectively as shown in FIGS. 6(A), 6(B). Therefore, as shown in FIGS. 7(A), 7(B), when the dies 40, 41 are advanced to closed position, the cavities 34 deform the first semi-worked projections 20, 29 to the first projections 5 and the cavities 36, 37 deform the second remained projections 30, 31 to the second projections 6, 7 respectively. Also, the bulge portions 42 and 44, 45 reduce the thickness of the strip 15 to less than that of flat portions 53, 54 of the strip to thereby form the pocket portions 10, 10 and peripheral portions, 11, 11 respectively. The thickness of the flat portions 53, 54 of the strip 15 corresponds to that of the leg portions 3, 4. Thus, the first and second projections 5 and 6, 7 are easily made not only by the deformation of the first semi-worked projections 20, 29 and the second remained projections 30, 31 respectively, but also by the flowing of the excess material of the strip 15 into the cavities which results from reduction in thickness in the course of forming the pocket portions 10, 10 and the peripheral portions 11, 11. In this invention, the amount of material which is necessary to emboss relatively high projections 5, 6, 7 can be easily obtained. Especially, in this invention, as the first semi-worked projections 5, 5 and the second remained projections are formed in the first working stage, the formation of the final first and second projections can be carried out with relatively low pressure without excess flow and strain in the material. The aforementioned formation of the first and second projections can be effected at one time or step by step.

In the next working step, the notches 55 are formed by punching out the flat portions 53, 54 of the strip to thereby form the external shape of the leg portions 3, 4 in the usual manner. After this, the strip 15 in which a series of fastener elements are formed is separated into the individual fastener elements 1 by severing the strip along the cut line 57 (FIG. 3) by use of suitable punch and die in the usual manner.

Although the invention is explained referring to the specific fastener element 1 of FIG. 1, the subject invention is not limited to this specific construction of fastener element and is applicable to other types of fastener elements.

Thus, in accordance with the present invention, since the metal strip which includes a pair of ridges on each side of the top and bottom surfaces thereof is used as the fastener element material and the first semi-worked projections and the second remained projections are formed from these ridges in the first working step, the formation of the final first and second projections in the following working step can be easily made without excess flow and strain in the material and embossed projections of sufficient height can be obtained with relatively low working pressure. Therefore, the resulting fastener chain has powerful interlocking force.

Also, in accordance with the invention, since the first and second projections are substantially made from the ridges on the strip, the thickness of the flat portion of the strip which corresponds to that of the leg portions can be determined from only the strength required for the leg portions. Therefore, the thickness of the flat portion of the strip, i.e. leg portion, can be made minimum. By this, the resistance to sliding movement of the slider over the resulting fastener chain is decreased and smooth slide movement of the slider can be obtained. Also, the resulting fastener chain has high flexibility. And further, the fastener elements can be produced with a minimum of material.

What is claimed is:

1. A method for manufacturing slide fastener elements from a metal strip by press working, each of said elements comprising a head portion and a pair of spaced leg portions extending rearwardly from the head portion, said head portion including on each side of the top and bottom surfaces thereof a first projection extending substantially perpendicular to the longitudinal direction of the leg portions and a pair of second projections each extending from near one end of the first projection to rearward, said method comprising steps of preparing a metal strip having two parallel ridges provided on each side of the top and bottom surfaces thereof and extending in longitudinal direction of the same, deforming the ridges on each side of the strip at predetermined spaces so as to intimately contact two ridges to each other at predetermined spaces to thereby form a series of first semi-worked projections and a series of second remained projections between the first semi-worked projections, deforming the first semi-worked projections and second remained projections to form the first projections and second projections respectively, simultaneously reducing the thickness of the inside and outside portions defined by the first semi-worked projections and the second remained projections to less than that of the leg portions so that the flow of excess material resulting from reduction in thickness of the strip portions contributes to the formation of the first and second projections, forming the external shape of the leg portions by punching the strip, and separating the strip into individual fastener elements by punching the same.

2. A method for manufacturing slide fastener elements as defined by claim 1, wherein said steps of deforming the first semi-worked projections and second remained projections and simultaneously reducing the thickness of the portions of the strip are conducted at one time.

3. A method for manufacturing slide fastener elements as defined by claim 1, wherein said first and second projections defining the pocket portion inside thereof and the peripheral portion outside thereof, and the thickness of said pocket portion and peripheral portion is reduced to less than that of said leg portions by said thickness reducing step.

* * * * *